US010882166B2

(12) United States Patent
Asplund

(10) Patent No.: US 10,882,166 B2
(45) Date of Patent: Jan. 5, 2021

(54) PULSE TOOL

(71) Applicant: ATLAS COPCO INDUSTRIAL TECHNIQUE AB, Stockholm (SE)

(72) Inventor: Daniel Per Erik Asplund, Huddinge (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 135 days.

(21) Appl. No.: 15/766,260

(22) PCT Filed: Sep. 23, 2016

(86) PCT No.: PCT/EP2016/072712
§ 371 (c)(1),
(2) Date: Apr. 5, 2018

(87) PCT Pub. No.: WO2017/063851
PCT Pub. Date: Apr. 20, 2017

(65) Prior Publication Data

US 2018/0290275 A1 Oct. 11, 2018

(30) Foreign Application Priority Data

Oct. 15, 2015 (SE) ..... 1551333

(51) Int. Cl.
*B25B 23/147* (2006.01)
*B25B 21/02* (2006.01)

(52) U.S. Cl.
CPC ..... *B25B 23/1475* (2013.01); *B25B 21/02* (2013.01)

(58) Field of Classification Search
CPC . B25B 23/1475; B25B 21/02; B25B 23/1405; B23P 19/065

(Continued)

(56) References Cited

U.S. PATENT DOCUMENTS 3,207,237 A * 9/1965 Wanner ..... B25B 21/02 173/93.5
3,693,726 A * 9/1972 Hornig ..... B25B 23/147 173/179

(Continued)

FOREIGN PATENT DOCUMENTS

CN 102015214 A 4/2011
DE 4024577 A1 2/1992

(Continued)

OTHER PUBLICATIONS

International Search Report (ISR), Written Opinion and International Preliminary Report on Patentability (IPRP) dated Jan. 20, 2017 issued in International Application No. PCT/EP2016/072712.

(Continued)

*Primary Examiner* — Robert F Long
(74) *Attorney, Agent, or Firm* — Holtz, Holtz & Volek PC

(57) ABSTRACT

An electric hand held pulse tool for performing tightening operations where torque is delivered in pulses to tighten screw joints. The pulse tool includes a bidirectional electric motor, an output shaft, a sensor for monitoring a parameter reflecting a delivered torque pulse, and a control unit for controlling the electric motor. The sensor provides information regarding the monitored parameter to the control unit. The control unit, during a tightening operation performed by the pulse tool in a first direction, controls the motor to provide at least one torque pulse on the output shaft in a second direction that is opposite to the first direction. The sensor monitors a parameter reflecting a delivered torque pulse on the output shaft in the second direction. The control unit also determines information about the nature and state of a joint, due to the torque pulse on the output shaft in the second direction.

13 Claims, 2 Drawing Sheets

(58) Field of Classification Search
USPC ..... 173/176
See application file for complete search history.

(56) References Cited

U.S. PATENT DOCUMENTS

| | | | | |
|---|---|---|---|---|
| 4,095,325 | A * | 6/1978 | Hashimoto | B25B 23/147 29/407.03 |
| 4,173,059 | A * | 11/1979 | Hashimoto | B25B 23/147 29/240 |
| 4,967,472 | A * | 11/1990 | Ebihara | B21D 7/12 29/712 |
| 5,065,494 | A * | 11/1991 | Ebihara | B21D 7/12 29/407.03 |
| 5,105,519 | A | 4/1992 | Doniwa | |
| 5,848,655 | A | 12/1998 | Cooper et al. | |
| 6,539,603 | B1 * | 4/2003 | Bulow | B23P 19/066 173/180 |
| 6,618,923 | B1 | 9/2003 | Quickert | |
| 8,485,273 | B2 * | 7/2013 | Elsmark | B25B 23/147 173/1 |
| 8,875,804 | B2 * | 11/2014 | Puzio | B25F 5/003 173/2 |
| 9,636,809 | B2 | 5/2017 | Elsmark | |
| 10,427,282 | B2 * | 10/2019 | Ishikawa | B25B 21/02 |
| 2002/0134172 | A1 * | 9/2002 | Yamada | B25B 23/1405 73/862.21 |
| 2003/0121677 | A1 * | 7/2003 | Watanabe | B25B 23/14 173/2 |
| 2004/0040727 | A1 * | 3/2004 | Miller | B25B 21/00 173/2 |
| 2004/0182588 | A1 * | 9/2004 | Tokunaga | B25B 23/1475 173/2 |
| 2011/0203822 | A1 | 8/2011 | Harada et al. | |
| 2011/0303427 | A1 * | 12/2011 | Tang | B23P 19/066 173/1 |
| 2012/0234566 | A1 * | 9/2012 | Mashiko | B25B 21/02 173/93.5 |
| 2013/0126202 | A1 * | 5/2013 | Oomori | B25B 21/00 173/217 |
| 2013/0133912 | A1 | 5/2013 | Mizuno et al. | |
| 2013/0264084 | A1 * | 10/2013 | Beckman | B25B 23/00 173/2 |
| 2018/0354108 | A1 * | 12/2018 | Lee | B25B 23/147 |
| 2019/0227528 | A1 * | 7/2019 | Abbott | G05B 13/0265 |

FOREIGN PATENT DOCUMENTS

| | | | |
|---|---|---|---|
| EP | 1056568 | A1 | 12/2000 |
| EP | 2607020 | A1 | 6/2013 |
| JP | S61279472 | A | 12/1986 |
| JP | H04030975 | A | 2/1992 |
| JP | 2011251354 | A | 12/2011 |
| JP | 2015512796 | A | 4/2015 |
| WO | 9853960 | A1 | 12/1998 |
| WO | 2015139952 | A1 | 9/2015 |

OTHER PUBLICATIONS

Chinese Office Action dated Feb. 27, 2019 issued in counterpart Chinese Application No. 201680059495.2.

Japanese Office Action (and English language translation thereof) dated Aug. 11, 2020 issued in Japanese Application No. 2018-518953.

* cited by examiner

PULSE TOOL

The invention relates to an electric pulse tool for performing tightening operations where torque is delivered in pulses to tighten and/or loosen screw joints. Specifically, the invention relates to an electric pulse tool including a sensor for monitoring a parameter reflecting a delivered torque pulse and a control unit: for controlling the electric motor during the tightening operation based on said monitored parameter.

BACKGROUND

During a tightening operation, in which a pulse tool is used for tightening a joint, torque is applied to the joint in pulses by a motor housed inside the pulse tool. Often it is desired to control the tightening such that a specific torque or clamp force is installed into the joint. The applied torque may be monitored by a torque sensor, but it may also be monitored by an angle meter, an accelerometer or a gyro that monitors the retardation of the output shaft so as to indirectly monitor the applied torque.

In a normal tightening operation only a part of the applied torque contributes to the torque or clamp force that is actually installed into the joint. The major part of the applied torque is lost in friction. The friction depends on temperature, humidity and type and condition of the thread. It is difficult, if not impossible, to foresee the friction with certitude in any given tightening operation.

Hence, there is always an uncertainty in how much of the applied torque that is installed into the joint and how much that is lost in friction. Under certain conditions the installed torque may be as low as 10 percent of the applied torque. The uncertainty with respect to the installed torque may lead to that for a tightening operation where the dynamically measured torque is within a predetermined interval that is considered as valid the clamp force or the statically installed torque may be too low or too high.

In the prior art there exists methods of monitoring the clamp force instead of the dynamical torque. Such methods are however cumbersome and time consuming as they involve the use of ultra sound sensors or the like, which are arranged to monitor the elongation of the screw or bolt in order to evaluate the clamp force.

Other methods exist for deducing the clamp force indirectly from the torque measured in opposite directions. From U.S. Pat. No. 5,105,519 it is known to, during a tightening operation of an otherwise continuous tightening operation, stopping and reversing the rotation of the motor so as to monitor the torque both in tightening and loosening of a joint. By comparing the torque to angle dependency during both tightening and loosening it is possible to determine the friction in the joint and to proceed the tightening towards a target value that corresponds to a torque installed in the joint rather than an applied torque. The method disclosed in U.S. Pat. No. 5,105,519 is however adapted to a fixed tool where there is no limitation in how much reaction torque the structure may withstand and where the time of concluding a specific tightening operation is not of uttermost importance.

For hand held power tools it is however important both that the reaction force that is subjected to the operator is as low as possible and that the time of concluding a specific tightening operation is as low as possible. An operator may conduct many hundreds of tightening operations during a working cycle and it is therefore important that they are both ergonomic for the well-being of the operator and rapid for the productivity at the work station. An ergonomic tightening operation typically implies that the reaction torque is as low as possible.

Hence, there is a need for a pulse tool that is adapted to deliver a torque in which the installed torque may be controlled and in which a tightening operation may be performed rapidly with a high reliability.

SUMMARY OF THE INVENTION

An object of the invention is to provide a torque delivering pulse tool with which the installed torque may be controlled and by means of which a tightening operation may be performed rapidly with a high reliability.

This object is achieved in accordance with a first aspect of the invention by an electric pulse tool for performing tightening operations where torque is delivered in pulses to tighten screw joints, the pulse tool comprising a bidirectional electric motor, an output shaft, a sensor for monitoring a parameter reflecting a delivered torque pulse, and a control unit for controlling the electric motor, wherein the sensor is arranged to provide information regarding the monitored parameter to the control unit. The control unit is arranged to, during a tightening operation performed by the electric pulse tool in a first direction, control the motor to provide at least one torque pulse in a second direction that is opposite to the first direction.

In accordance with a second aspect the invention relates to a method of tightening a screw joint with an electric pulse tool, the method comprising:

- pulsing an output shaft of the pulse tool in a first direction so as to tighten a joint,
- monitoring a parameter reflecting a delivered torque pulse in the first direction. The method further comprises pulsing the output shaft in a second direction that is opposite to the first direction, and monitoring a parameter reflecting a delivered torque pulse in said second direction.

With the invention according to the first and the second aspect an increased reliability may be achieved by an operation step that is easy to implement and that does not slow down the tightening operation. In fact, the tightening operation will be more rapid compared to a common pulse method in which the torque increments are often decreased as the torque approaches the target torque. The torque pulse or pulses that in accordance with the invention is/are provided in the second direction provides information regarding the torque that is actually installed into the joint and thereby the torque increments may be adjusted so as to bring the torque as close as possible to a target torque, without the need of decreasing the torque increment.

Also, the clamp force may be estimated such that the torque increments may be adapted to a specific target clamp force, instead of a target torque.

Other features and advantages of the invention will be apparent from the dependent claims, the drawings and from the detailed description of the shown embodiment.

SHORT DESCRIPTION OF THE DRAWINGS

In the following detailed description reference is made to the accompanying drawings, of which:

DETAILED DESCRIPTION OF THE SHOWN EMBODIMENT OF THE INVENTION

Figure 1:
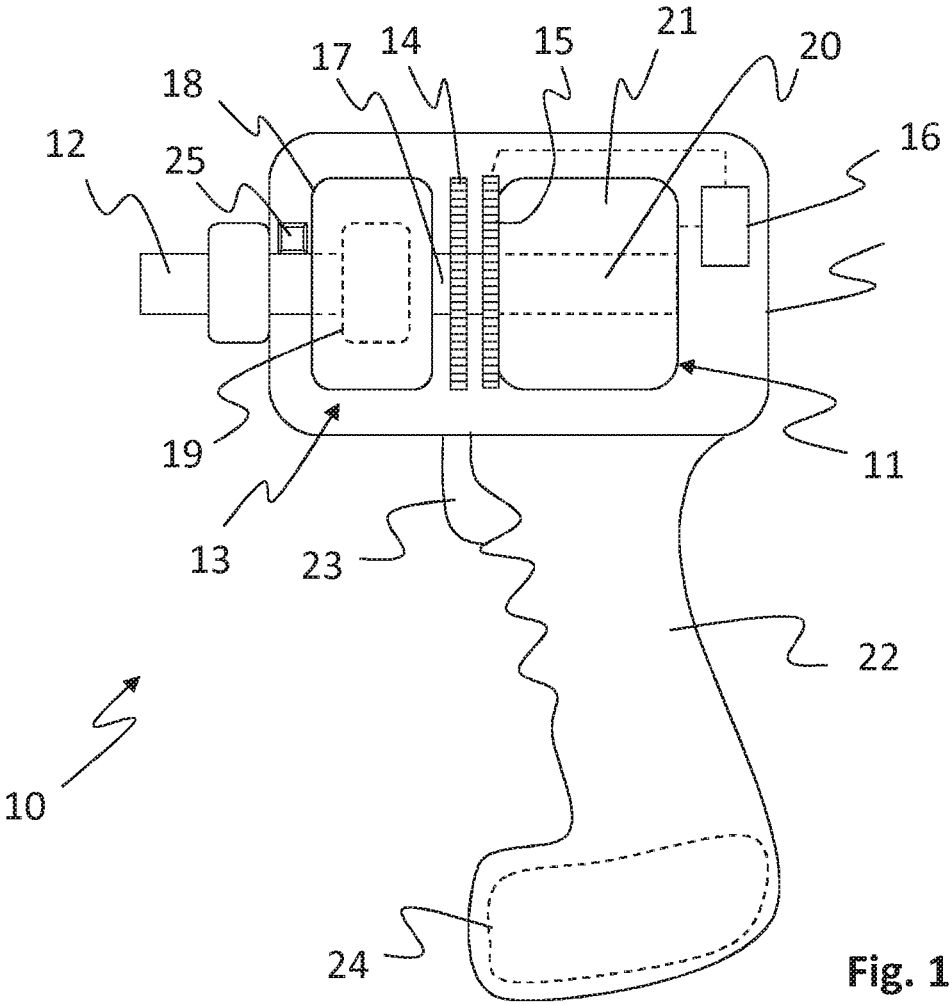
FIG. 1 is a schematic representation of a pulse tool according to a specific embodiment of the invention.

In FIG. 1 an electric pulse tool 10 in accordance with a specific embodiment of the invention is schematically shown. The pulse tool 10 is configured to perform tightening operations where torque is delivered in pulses to tighten screw joints. For this purpose the pulse tool comprises a bidirectional electric motor 11 which is arranged to deliver torque in two opposite rotational directions, i.e. clockwise and counter clockwise.

The electric pulse tool 10 further comprises a handle 22, which is of a pistol type in the shown embodiment. The invention is however intended to cover any type of handheld pulse tools. A power supply 24, such as a battery, is arranged in the lower part of the handle and a trigger 23 is arranged for manipulation of the operator so as to power the electric motor 11. The power supply may also be a connection to an electric cable.

Further, the pulse tool comprises an output shaft 12 and a sensor 14,15,25 for monitoring a parameter reflecting a delivered torque pulse. The sensor may be a torque sensor, an angle sensor, an accelerometer, a gyro, or the like. In the shown embodiment there is a first sensor 14,15 that consists of an angle sensor that monitors the rotation of an input shaft 17 by means of a rotational sensor part 14 and a static sensor part 15. A second sensor 25 in the form of a torque sensor is arranged on the output shaft 12. For the invention either an angle sensor or a torque sensor is needed, not both.

However, both sensors may be provided to offer increased accuracy or redundancy.

The shown embodiment further comprises a pulse unit 13 comprising an inertia body 18 that houses a piston activated rotator 19. The inertia body 18 is rigidly connected to the input shaft 17 and driven by a rotor 20 of the motor 11. The rotor 20 is in the shown embodiment arranged coaxially inside a stator 21 of the motor 11. A pulse is generated as cam surfaces (not shown) on the inside of the inertia body 18 interacts with the pistons so as to force the rotator 19 to rotate in a conventional manner well known in the art.

The invention is however not limited to pulse tools with a pulse unit. Pulses may also be produced in pulse tools with a direct connection between the motor and the output shaft by pulsing the output of the motor of the pulse tool. The invention also covers such pulse tools and striking pulse tools often known as impact wrenches.

For a pulse tool including a pulse unit the angle sensor 14,15 may be arranged to monitor both the rotation of the inertia body 19 and the retardation of the same. The retardation may be used to calculate the torque that is installed into the joint. The torque sensor 25 is arranged to measure the torque directly. The torque meter is arranged on the output shaft 12 as close as possible to the joint in order to monitor the delivered torque.

A control unit 16 is arranged to control the electric motor 11. The sensor 14,15,25 is arranged to provide information regarding the monitored parameter to the control unit 16. This is conventional in controlled tightening operations where the tightening is governed towards a specific target value, such as target torque, angle or clamp force.

Figure 2:
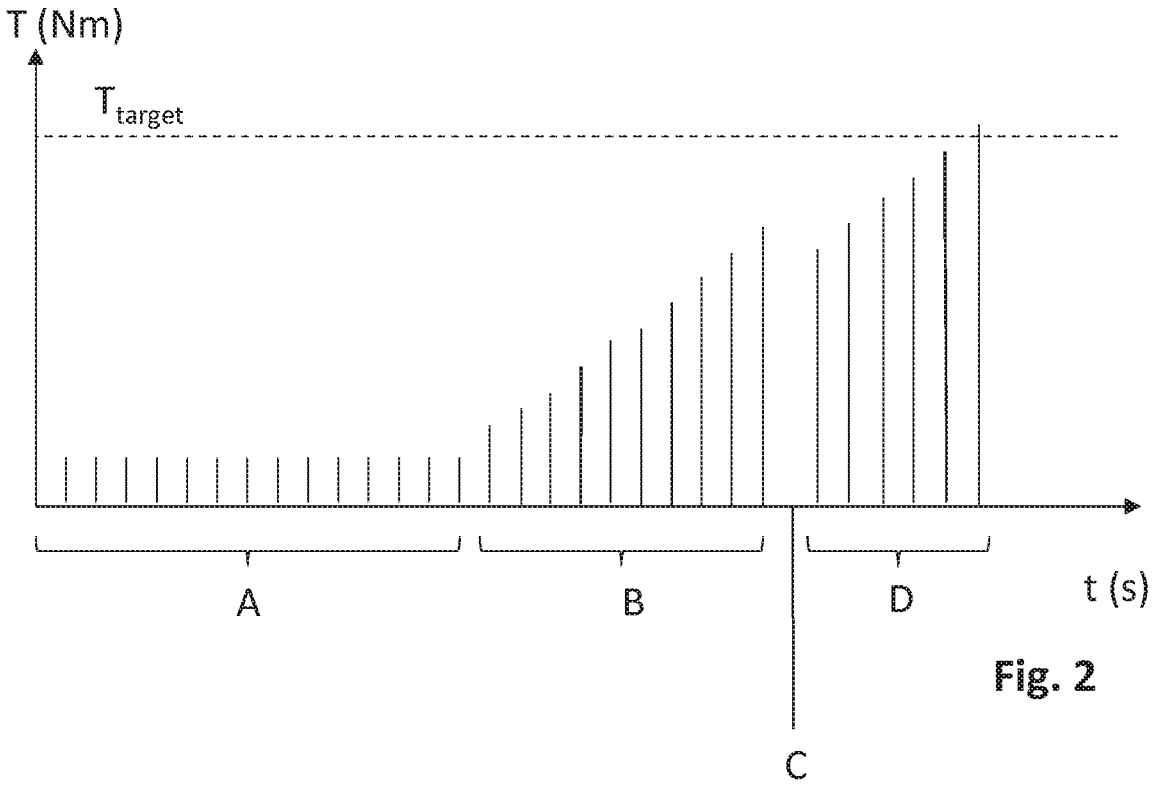
FIG. 2 is a schematic representation of the delivered torque as a function of operation time.
Figure 3:
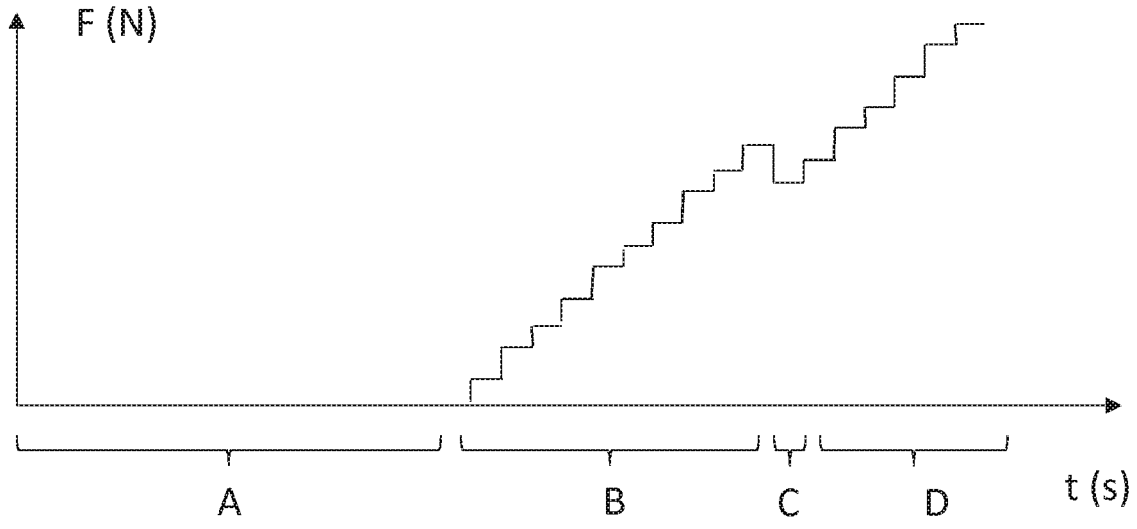
FIG. 3 is a schematic representation of the clamp force installed in a joint as a function of operation time.

In the inventive pulse tool 10 the control unit 16 is arranged to, during a tightening operation performed by the electric pulse tool 10 in a first direction, control the motor 11 to provide at least one torque pulse in a second direction that is opposite to the first direction. This is illustrated in FIGS. 2 and 3. In FIG. 2 the delivered torque T is illustrated as a function of time t during a tightening operation and in FIG. 3 the installed clamp force F is illustrated as a function of time t during the same tightening operation.

The tightening operation is illustrated as comprising 4 phases A-D. Typically, the illustrated tightening operation is a tightening of a fastener such as a screw into a joint. In the first phase A torque pulses of a constant torque are delivered so as to screw the fastener into a thread without imparting any clamp force into the joint. At this point the torque is only needed to overcome the friction in the threads. Torque that is delivered in addition to the torque needed to overcome the friction will accelerate the fastener.

In phase B the head of the screw has reached the joint and for every delivered torque pulse additional clamp force is stepwise installed into the joint as the strain in the fastener is increased. During this phase the torque increases substantially linearly with the angle rotation of the fastener and, since the torque is delivered in pulses, in steps with respect to the time t. For each pulse during phase B, which lasts for a very short period of time, i.e couple of milliseconds, a substantially constant clamp force increase is achieved.

In phase C one or more torque pulses are provided in a direction opposite to the rotational direction of the pulses in phase B. As is known in the prior art a loosening torque over specific angular interval may be utilised to determine the friction in the joint and to deduce the torque that has been installed into the joint. This information may be instantly processed by the control unit 16 so as to increase the accuracy of the tightening. As an example it will be possible to deduce the clamp force that has been installed into the joint. As is visible in the respective diagrams of FIGS. 2 and 3, the delivered torque T in phase C is negative, and hence, the clamp force F installed in the joint decreases in phase C.

In phase D the tightening operation is concluded towards a specific target value, such as a target torque, target angle or target clamp force. A target may be either higher or lower than the torque accomplished during phases A-C, but under most circumstances the target will be higher such that the joint will need to be tightened further. The difference with respect to a normal tightening operation is that the control unit has more information about nature and state of the joint at this point, as a consequence of the pulse in the opposite direction during phase C. This additional information may be concluded from one single pulse in the opposite direction.

Preferably, the sensor 14,15 that is arranged to monitor a parameter that reflects a delivered torque pulse in the first direction may also monitor a parameter that reflects a delivered torque pulse in the second direction. This is readily achievable with an angle meter as illustrated in FIG. 1. Such an angle meter 14,15 may be configured to monitor the rotation in both directions and to deduce the retardation of the pulse unit 13 or of the output shaft 12 in both directions.

Of course, in the embodiment where the sensor is a torque meter, the torque meter may also be configured to monitor the torque in both directions. A torque is typically arranged to monitor the absolute torque, i.e. without information in which direction the torque acts. The control unit 16 will however register the torque as negative or positive as a function of in which direction it has controlled the motor 11 to rotate.

Above, the invention has been described with reference to a specific embodiment. The invention is however not limited to this embodiment. It is obvious to a person skilled in the art that the invention comprises further embodiments within its scope of protection, which is defined by the following claims.

The invention claimed is:

1. An electric hand held pulse tool for performing a tightening operation in which torque is delivered in pulses to tighten a screw joint, the electric hand held pulse tool comprising:

a bidirectional electric motor;

an output shaft;

a sensor for monitoring a parameter reflecting a delivered torque pulse; and a control unit for controlling the electric motor, wherein:

the sensor is configured to provide information regarding the monitored parameter to the control unit, the control unit is configured to, during a tightening operation performed by the electric hand held pulse tool in a first direction, control the motor to provide at least one torque pulse on the output shaft in a second direction that is opposite to the first direction, the sensor is further configured to monitor a parameter reflecting a delivered torque pulse on the output shaft in the second direction, the control unit is further configured to determine information regarding a torque that has actually been installed into the screw joint during the tightening operation, using information provided from the sensor regarding the at least one torque pulse on the output shaft in the second direction, and the control unit is further configured to adjust torque applied during a remainder of the tightening operation in the first direction, using the determined information regarding the torque that has actually been installed into the screw joint, said remainder of the tightening operation taking place after the at least one torque pulse on the output shaft in a second direction.

2. The electric hand held pulse tool according to claim 1, wherein the sensor is a torque sensor.

3. The electric hand held pulse tool according to claim 1, further comprising a pulse unit that intermittently connects the motor to the output shaft.

4. The electric hand held pulse tool according to claim 3, wherein the sensor is an angle meter monitoring rotation and retardation of an inertia body of the pulse unit.

5. A method of tightening a screw joint with an electric hand held pulse tool, the method comprising:

performing a tightening operation in a first direction by pulsing an output shaft of the electric hand held pulse tool in the first direction so as to tighten the screw joint;

monitoring a parameter reflecting a delivered torque pulse in the first direction;

pulsing the output shaft in a second direction that is opposite to the first direction, during the tightening operation in the first direction;

monitoring a parameter reflecting a delivered torque pulse on the output shaft in the second direction;

determining information regarding a torque that has actually been installed into the screw joint during the tightening operation, using information on the monitored parameter reflecting the torque pulse on the output shaft in the second direction; and adjusting torque applied during a remainder of the tightening operation in the first direction, using the determined information regarding the torque that has actually been installed into the screw joint, said remainder of the tightening operation taking place after the at least one torque pulse on the output shaft in a second direction.

6. The method according to claim 5, wherein the pulsing the output shaft in the second direction that is opposite to the first direction consists of pulsing the output shaft only one time in the second direction that is opposite to the first direction.

7. The method according to claim 5, wherein the pulsing the output shaft in the second direction that is opposite to the first direction comprises pulsing the output shaft a plurality of times in the second direction that is opposite to the first direction.

8. The method according to claim 5, wherein the tightening operation comprises:

a first phase during which torque pulses in the first direction are delivered without installing any clamp force into the screw joint, a second phase which is after the first phase, and during which torque pulses in the first direction are delivered and clamp force is installed into the screw joint, a third phase which is after the second phase and during which the output shaft is pulsed in the second direction that is opposite to the first direction, and a fourth phase which is the remainder of the tightening operation after the third phase and during which torque pulses in the first direction are delivered to achieve a specific target value in the screw joint, and wherein the fourth phase comprises the adjusting of the torque using the determined information regarding the torque that has actually been installed into the screw joint.

9. The method according to claim 8, wherein the pulsing in the second direction is only performed in the third phase only in the third phase of the tightening operation.

10. The electric hand held pulse tool according to claim 1, wherein the control unit is configured to, during the tightening operation performed by the electric hand held pulse tool in the first direction, control the motor to provide only one torque pulse on the output shaft in the second direction that is opposite to the first direction.

11. The electric hand held pulse tool according to claim 1, wherein the control unit is configured to, during the tightening operation performed by the electric hand held pulse tool in the first direction, control the motor to provide a plurality of torque pulses on the output shaft in the second direction that is opposite to the first direction.

12. The electric hand held pulse tool according to claim 1, wherein the tightening operation comprises:

a first phase during which torque pulses in the first direction are delivered without installing any clamp force into the screw joint, a second phase which is after the first phase, and during which torque pulses in the first direction are delivered and clamp force is installed into the screw joint, a third phase which is after the second phase and during the control unit is configured to control the motor to provide the at least one torque pulse on the output shaft in the second direction that is opposite to the first direction, and a fourth phase which is the remainder of the tightening operation after the third phase and during which the control unit is configured to control the motor to deliver torque pulses in the first direction to achieve a specific target value in the screw joint, and wherein during the fourth phase the control unit is configured to adjust the torque applied during the remainder of the tightening operation in the first direction, using the determined information regarding the torque that has actually been installed into the screw joint.

13. The electric hand held pulse tool according to claim 1, wherein the control unit is configured to control the motor to provide the at least one torque pulse on the output shaft in the second direction only in the third phase of the tightening operation.

* * * * *